US007644851B2

(12) United States Patent
Sugihara et al.

(10) Patent No.: US 7,644,851 B2
(45) Date of Patent: Jan. 12, 2010

(54) STAPLER

(75) Inventors: Shinpei Sugihara, Tokyo (JP); Kiichi Haramiishi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 36 days.

(21) Appl. No.: 11/578,193

(22) PCT Filed: Apr. 8, 2005

(86) PCT No.: PCT/JP2005/006920

§ 371 (c)(1),
(2), (4) Date: Oct. 11, 2006

(87) PCT Pub. No.: WO2005/099969

PCT Pub. Date: Oct. 27, 2005

(65) Prior Publication Data

US 2007/0210136 A1 Sep. 13, 2007

(30) Foreign Application Priority Data

Apr. 14, 2004 (JP) ..... 2004-118574

(51) Int. Cl.
*B25C 7/00* (2006.01)

(52) U.S. Cl. ..... 227/155; 227/77

(58) Field of Classification Search ..... 227/155, 227/18, 99, 154, 153, 138, 139, 156, 77
See application file for complete search history.

(56) References Cited

U.S. PATENT DOCUMENTS 2,267,185 A * 12/1941 Bauwens ..... 227/77
4,194,666 A * 3/1980 Spehrley et al. ..... 227/155
4,436,234 A * 3/1984 Kennedy ..... 227/4
4,593,847 A * 6/1986 Hagemann ..... 227/155
5,004,142 A * 4/1991 Olesen ..... 227/155
5,029,745 A * 7/1991 Akizawa et al. ..... 227/155
5,346,114 A * 9/1994 Udagawa et al. ..... 227/120
5,516,025 A * 5/1996 Eriksson ..... 227/155
5,586,710 A * 12/1996 Golicz ..... 227/155
5,758,813 A * 6/1998 Kikuchi et al. ..... 227/155
6,036,074 A * 3/2000 Manabe ..... 227/155
6,056,183 A * 5/2000 Tanabe ..... 227/155

(Continued)

FOREIGN PATENT DOCUMENTS

JP 61-166775 U 10/1986

(Continued)

OTHER PUBLICATIONS

Machine translation obtained Jan. 23, 2008 of Japanese application 2003-073209, filed Mar. 18, 2003 and published Feb. 12, 2004.*

*Primary Examiner*—Paul R Durand
(74) *Attorney, Agent, or Firm*—Morgan, Lewis & Bockius LLP

(57) ABSTRACT

Clincher holders hold a pair of clinchers for bending the legs of a staple driven by a driver, and have slanting guide faces for guiding the tips of the legs of the staple toward the clinchers. In a stapling table for receiving sheets of paper, an opening is made. The clincher holders are movable inside the opening. Drop-preventing portions for preventing the sheets of paper from dropping inside the opening in stapling are projected from opening edges of the opening toward the inside of the opening.

14 Claims, 11 Drawing Sheets

U.S. PATENT DOCUMENTS

| | | | | |
|---|---|---|---|---|
| 6,059,504 | A * | 5/2000 | Ishida et al. | 227/155 |
| 6,634,537 | B2 * | 10/2003 | Chen | 227/140 |
| 7,108,165 | B2 * | 9/2006 | Tsai | 227/155 |
| 7,124,925 | B2 * | 10/2006 | Ishizaki | 227/155 |
| 7,228,999 | B2 | 6/2007 | Oide et al. | 277/155 |
| 2006/0043146 | A1 * | 3/2006 | Oide et al. | 227/155 |

FOREIGN PATENT DOCUMENTS

| | | | |
|---|---|---|---|
| JP | 6-83281 U | | 11/1994 |
| JP | 2003-073209 | * | 3/2003 |
| JP | 2003-165105 | | 6/2003 |
| JP | 2003-205506 | | 7/2003 |

* cited by examiner

STAPLER

TECHNICAL FIELD

The present invention relates to a stapler having a clincher holder, for a clincher for bending legs of a staple, which is movably provided inside an opening of a clincher unit.

BACKGROUND ART

Generally, in the stapler, a driver side for driving a staple and a clincher side for bending the legs of the staple driven are opposed to each other so that sheets of paper to be stapled are inserted between the driver side and the clincher side. Previously known are an integral type stapler in which members on the driver side and members on the clincher side are pivotally supported coaxially as in an ordinary manual stapler, and a separated type stapler in which members on the driver side and members on the clincher side are separated and moved in the same direction. The former is effective in stapling the side end or corner of the sheets of paper such as stapling a plurality of documents in paperwork handling. The latter is effective in inserting the sheets of paper from one side between the members on the driver side and the members on the clincher side and passing them toward the other side, such as center-stapling the central portion of a magazine.

An important thing in the stapler is an alignment state in which the legs of the staple driven by the driver and penetrating through the sheets of paper surely hit against the clincher. If the alignment state is appropriate, the legs of the staple are exactly bent so that the sheets of paper can be stapled. Therefore, consideration is given so that the driver and the clincher align in predetermined positions in stapling.

In the integral type stapler, in which the driver and the clincher are supported on a common axis, they can be relatively easily aligned in their position. On the other hand, in the separated type stapler, in which the driver and the clincher are fixed by different means, it is difficult to exactly position both units. Particularly, in recent years, the separated type stapler are required to enable not only the center-stapling but also corner-stapling and side-stapling. In order to fill this requirement, the driver unit and clincher unit must be simultaneously moved in the same direction. Even if they are fixed at the same position, their alignment is difficult. In addition, when both units are exactly moved by the same distance in the same direction by separate means, respectively, not only a component tolerance but also an attaching error such as the center-matching of the stapler by a user are accumulated so that their alignment is very difficult.

In order to avoid such inconvenience, JP-A-2003-205506 discloses a stapler provided with an automated alignment mechanism which does not fix the clincher at predetermined positions of the clincher unit but supports the clincher so that the clincher is movable relatively to the clincher unit, thereby moving the clincher according to the position of the legs of the staple having penetrated through the sheets of paper. In this stapler, at receiving positions of the legs of the staple on the upper surface of the clincher holder supporting the clincher, guide faces inclined toward the clincher are formed so that the clincher holder is supported so as to be movable inside an opening formed in a stapling table receiving the sheets of paper. If tips of the legs of the staple slightly deviate from a predetermined position to hit against the guide faces of the clincher holder, the clincher holder moves together with the guide faces so that the tips of the legs of the staple are received by the clincher.

In accordance with the above configuration, even if the legs of the staple which have been driven in stapling by the driver and penetrated through the sheets of paper are deviated from the predetermined position, the clincher move to the position corresponding to that of the legs. Therefore, the legs of the staple are exactly bent, thereby giving appropriate stapling.

However, some staplers are required to staple the position apart by about 3 mm from by the side end of the sheets of paper. In this case, as shown in FIG. 9A, an opening 31 of a stapling table formed around clincher holders 30 is formed with a size larger than the clincher holder 30 so that the clincher holder 30 is movable inside the opening 31. Therefore, when the legs 11 of the staple penetrating through the sheets of paper "a", the side end of the sheets of paper "a" may drop inside the opening 31 owing to the pressure from the legs 11. At this time, the pressure of the sheets of paper "a" is applied to the clincher holder 30. Owing to this, as shown in FIG. 9B, even when the legs 11 of the staple hit against the guide face of the clincher holder 30, the dropped zone "a1" of the sheets of paper "a" holds down the clincher holder 30 by the above pressure so that the clincher holder 30 cannot move. Further, when the sheets of paper have dropped inside the opening 31 by clamping, a sheaf of the sheets of paper "a" becomes deformed so that the legs 11 of the staple may be driven in a direction different from the direction perpendicular to the surface of the sheets of paper. This may give rise to buckling or rolling of the legs 11 of the staple, thus leading to poor stapling.

DISCLOSURE OF THE INVENTION

In order to solve the above problems, embodiments of the present invention provides a stapler which can prevent sheets of paper from dropping inside an opening of a stapling table in stapling so that a clincher holder for a clincher can surely freely move.

In a staple according to embodiments of the present invention, a clincher holder is provided so as to hold a pair of clinchers for bending the legs of a staple driven by a driver and includes slanting guide faces for guiding the tips of the legs of the staple to the clinchers, and the clincher holder is provided in an opening formed in a stapling table for receiving sheets of paper so that the clincher holder is movable inside the opening. A drop-preventing portion for preventing the sheets of paper from dropping inside the opening in stapling is projected from an opening edge of the opening toward an inside of the opening.

Further, the drop-preventing portion may be integrally formed with an opposed opening edge of the opening so as to project from the opening edge.

Other aspects and advantages of the invention will be apparent from the following description and the appended claims.

Figure 1:
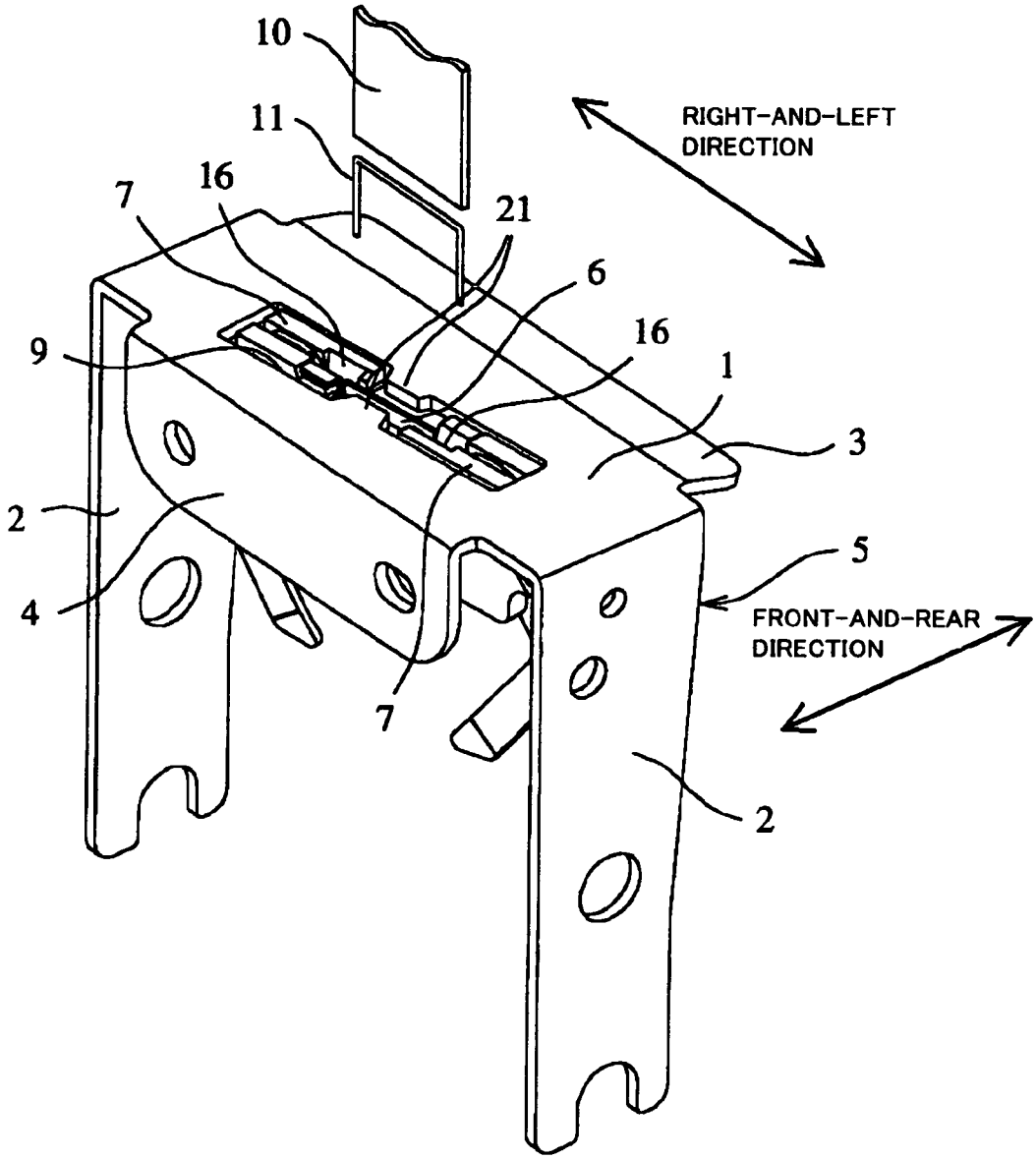
FIG. 1 is a perspective view of the main part of a clincher unit according to an embodiment of the present invention.

DESCRIPTION OF REFERENCE NUMERALS AND SIGNS a sheets of paper
1 stapling table
6 clincher
7 clincher holder
9 opening
17 guide face
21 drop-preventing portion

BEST MODE FOR CARRYING OUT THE INVENTION

An embodiment of the invention will be described with reference to the accompanying drawings.

FIG. 1 shows a main part of the clincher unit of a separated type stapler in which a driver unit and a clincher unit are separated from each other.

The clincher unit has a clincher 6 and a clincher holder 7 which are arranged inside a frame 5 including a square stapling table 1 for receiving sheets of paper, dangling pieces 2 on both the right and left sides thereof, a front slanting piece 3 and a rear vertical piece 4. The frame 5 is fixed to a clincher unit box (not shown). A square opening 9 is made centrally in the table 1. The length in a right-and-left direction of the opening 9 is longer than that in the front-and-rear direction thereof. Incidentally, the clincher unit box is coupled with a moving means (not shown) and adapted to be movable in the same direction (horizontal direction) together with a driver unit box (not shown) coupled with another driving means.

Figure 2:
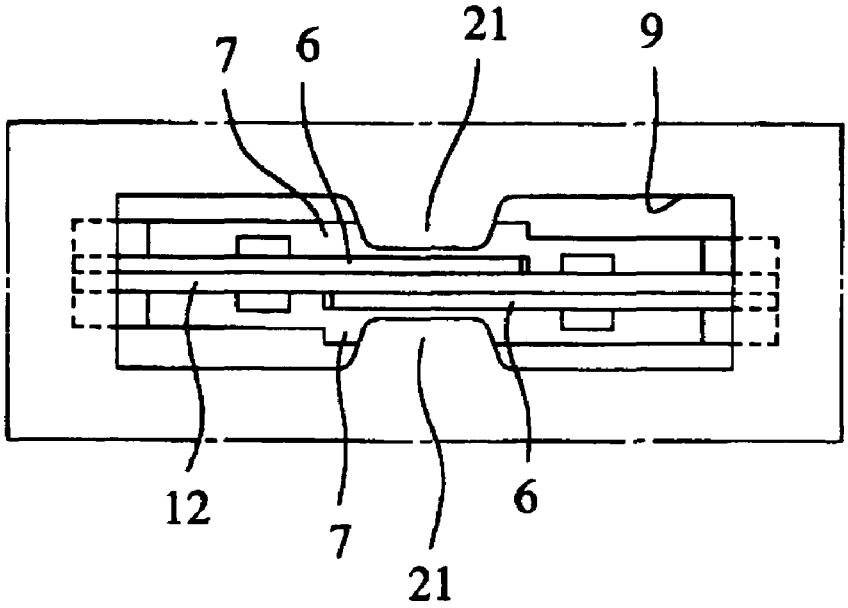
FIG. 2 is a cross sectional view of the clincher unit.

Next, the clincher 6 serves to receive and bend the legs 11 of the staple driven by a driver 10 and penetrating through the sheets of paper. The staple is composed of a crown straightly extending in a right-and-left direction and legs 11 extending downward from both right and left ends of the crown, respectively. As shown in FIG. 2, a pair of clinchers 6 are arranged between two clincher holders 7. Between the two clincher holders 7, a partitioning plate 12 is located. The clinchers 6 are arranged on both sides of the partitioning plate 12. Each clincher 6 is pivotally supported by a supporting shaft 13 attached to the clincher holder 7 and the partitioning plate 12.

Figure 3:
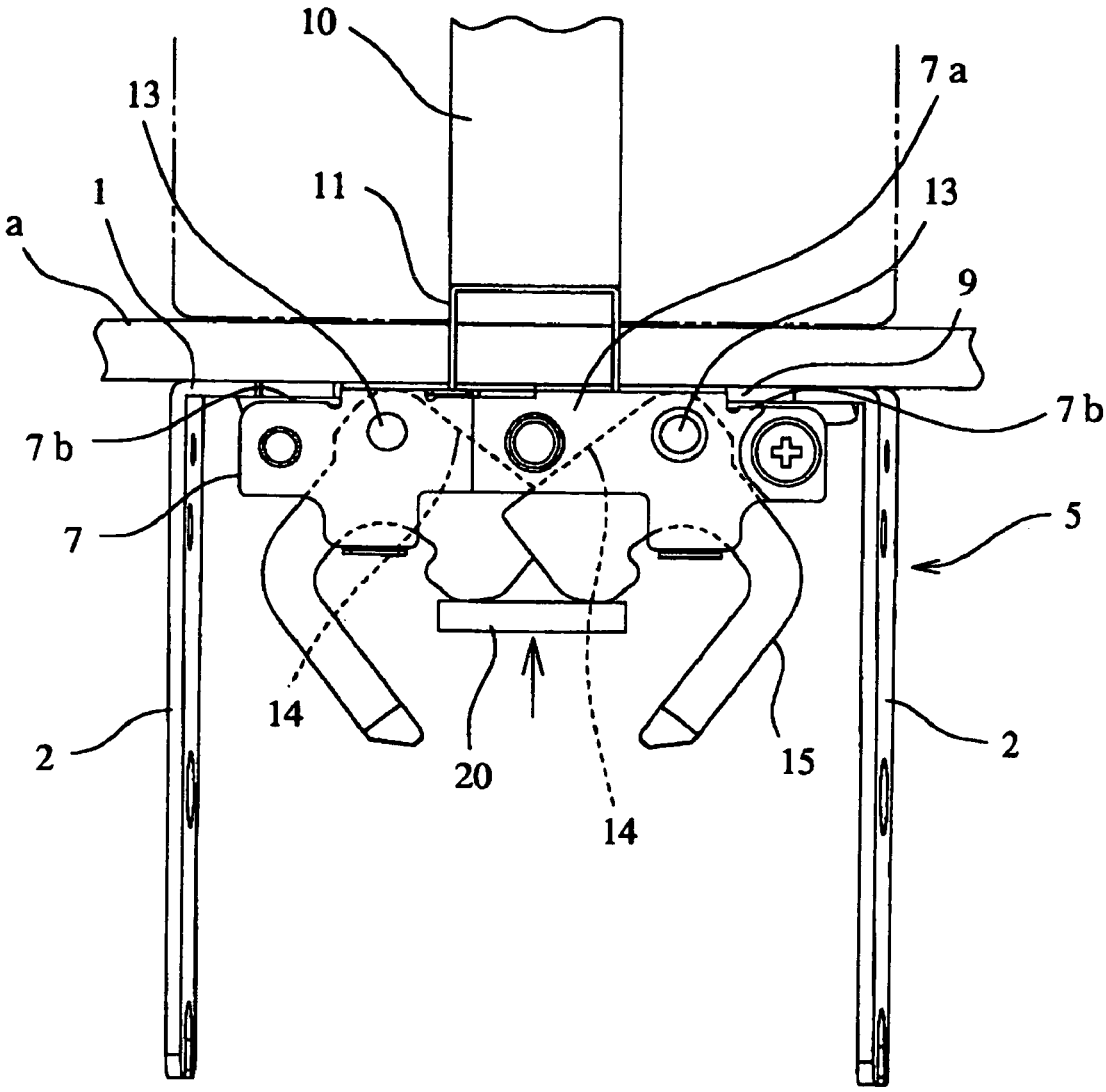
FIG. 3 is a front view of the clincher unit.

Inside the supporting shaft 13, the clincher 6, as shown in FIG. 3, has an upper face 14 receiving the leg 11 of the staple passed through the sheets of paper. Outside the supporting shaft 13, the clincher 6 has a leg piece 15 bent at right angles in the intermediate zone.

Figure 4:
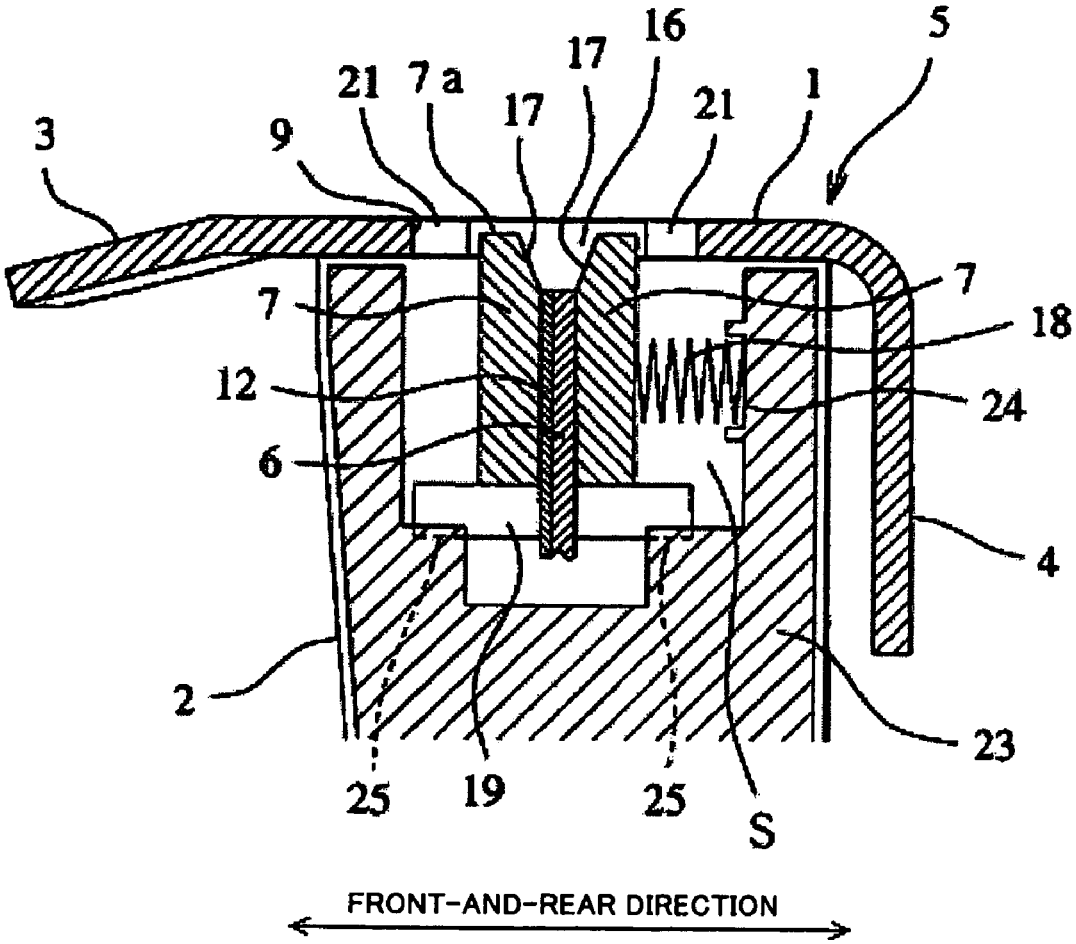
FIG. 4 is a view for explaining the attached state of a clincher holder.
Figure 5:
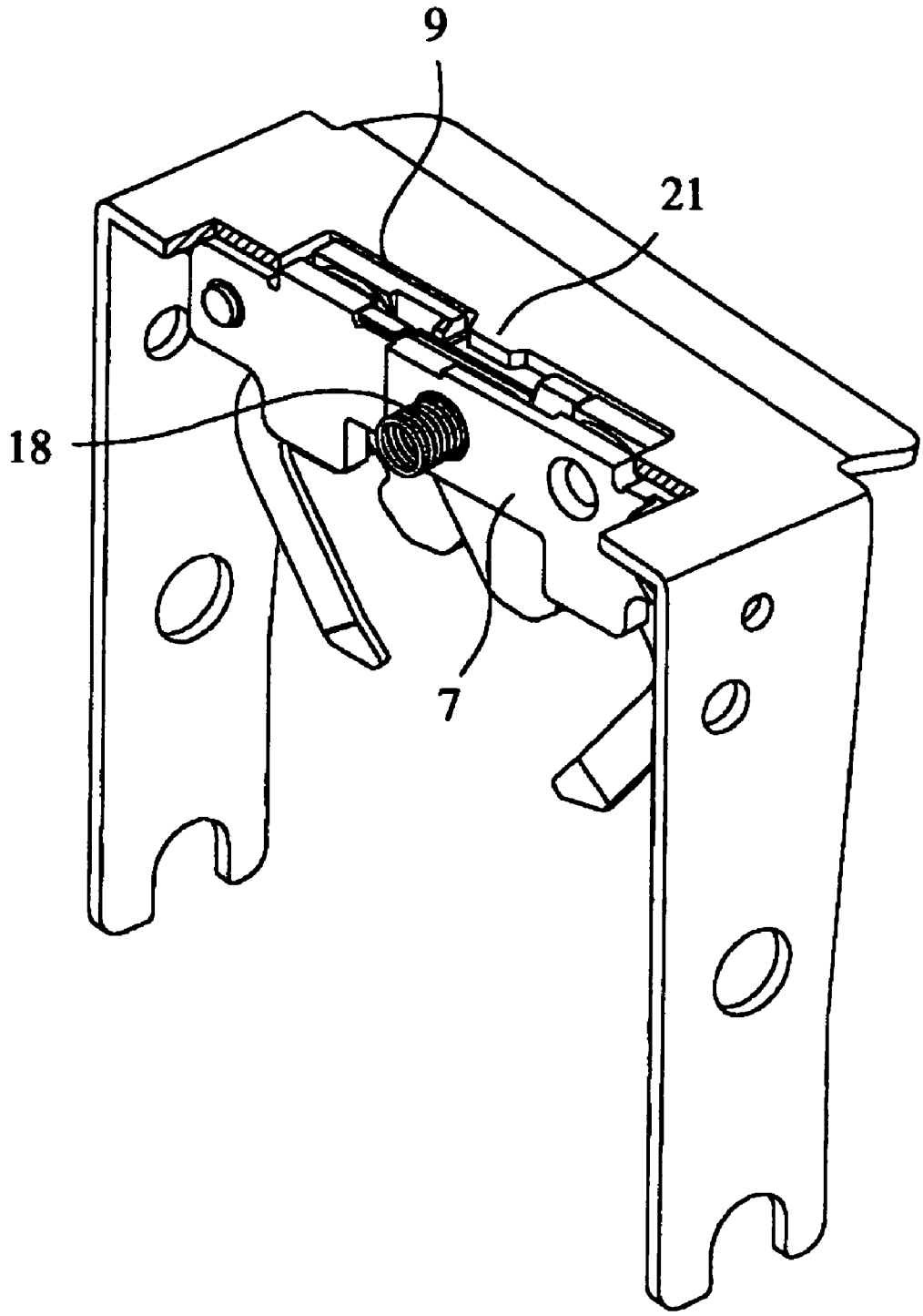
FIG. 5 is a partially exploded perspective view of the clincher unit.

The clincher holders 7 are formed of a pair of thick plate-like members. Each of the clincher holder 7 has, at its center of the upper end, a convex 7*a* projecting upward from shoulder 7*b* on both sides. As shown in FIG. 3, the convex 7*a* at the center of the upper end of the clincher holder 7 is positioned inside the opening 9 of the stapling table 1 of the frame 5. The shoulders 7*b* on both sides are supported by the lower face of the frame 5 so as to be in contact therewith or adjacent thereto. The clincher holder 7 has a pair of right and left guiding portions 16 (see FIG. 1) at the areas where the legs 11 of the staple having penetrated through the sheets of paper may be received. As shown in FIG. 4, each guiding portion 16 has a pair of guide faces 17 slanting in the front-and-rear direction toward the clincher 6 on the inside.

Further, a clincher base 23 of synthetic resin is fit in the frame 5. In the upper space S of the clincher base 23, the clincher holders 7 are arranged. A coil spring 18 is arranged between the inner wall 24 of the upper space and clincher holder 7. The one end of the coil spring 18 is secured to the clincher holder 7 whereas the other end thereof is secured to the inner wall 24. The clincher holders 7 are movably supported on a shaft 19 provided in the front-and-rear direction. The shaft 19 is attached to a receiving portion 25 on the bottom of the above space S in the frame 5.

Further, a clincher arm 20 (see FIG. 3) is arranged beneath the clincher holders 7. The clincher arm 20 is coupled with a driving mechanism (not shown) which presses the clinchers 6 in an arrow direction so that their upper faces 14 becomes horizontal.

As described above, the clincher holders 7 which support the pair of clinchers 6 are supported on the frame 5 by the coil spring 18. In this case, the clincher holders 7 are movable so that the convexes 7*a* at the center of the upper end of the clincher holders 7 are within the opening 9 of the stapling table 1. Therefore, as the opening 9 is large, the movable range of the clincher holders 7 is large.

Figure 6:
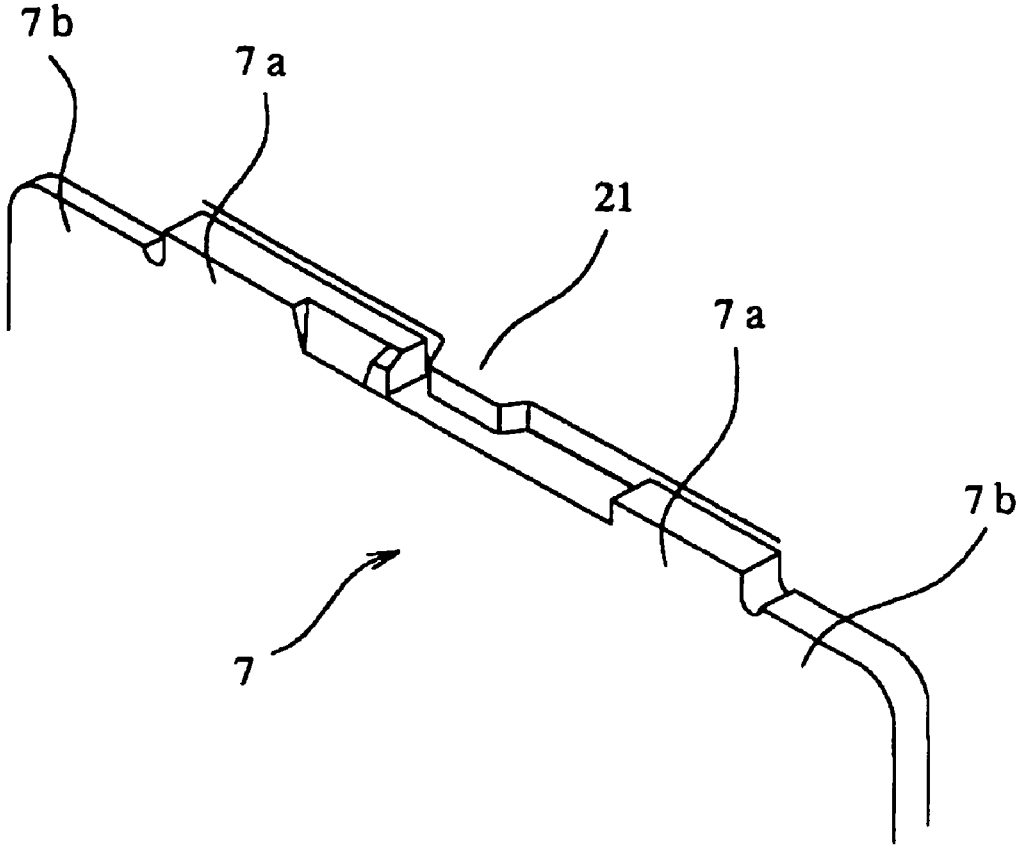
FIG. 6 is an enlarged view of a region of a drop-preventing portion.

As illustrated in FIG. 6 in detail, a drop-preventing portion 21 is projected from a center of an opening edges of the opening 9 in the front-and-rear direction toward the inside of the opening 9. Specifically, the drop-preventing portion 21 includes a front drop-preventing portion which is projected toward the inside of the opening at a substantially central position in the right-and-left direction of a front opening edge, and a rear drop-preventing portion which is projected toward the inside of the opening at a substantially central position in the right-and-left direction of a rear opening edge. In other words, the drop-preventing portion 21 are projected from the opening edges toward the inside of the opening between the region of the opening opposed to the right guiding portion and a region of the opening opposed to the left guiding portion.

Figure 7A:
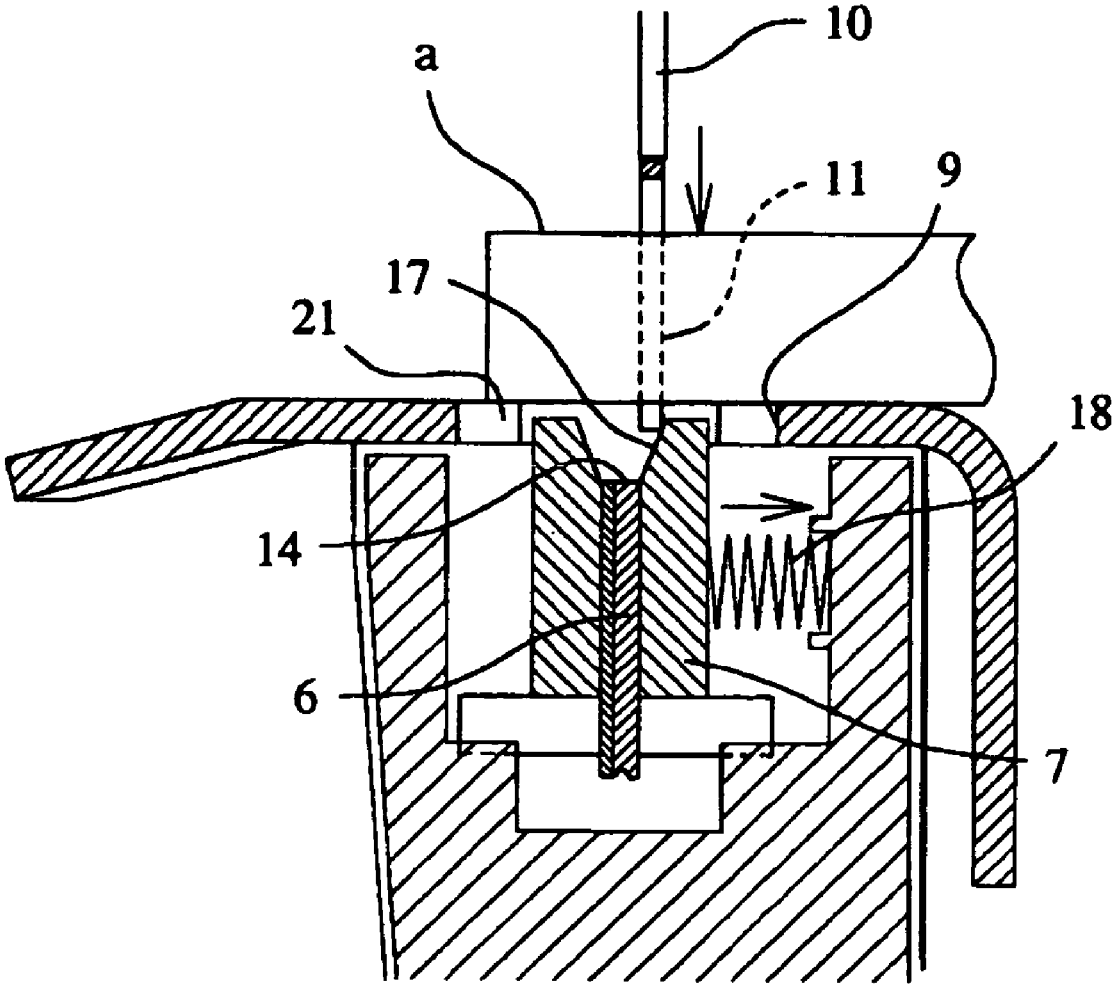
FIG. 7A is a view for explaining the operating manner of the clincher, illustrating the process in which the legs of a staple pass through the sheets of paper.

In accordance with the above configuration, in stapling, when the driver unit and the clincher unit approach to clamp the sheets of paper "a" on the table 1 between both units, as shown in FIG. 7A, the driver 10 operates to drive the staple so that the legs 11 of the staple penetrate through the sheets of paper.

Figure 7B:
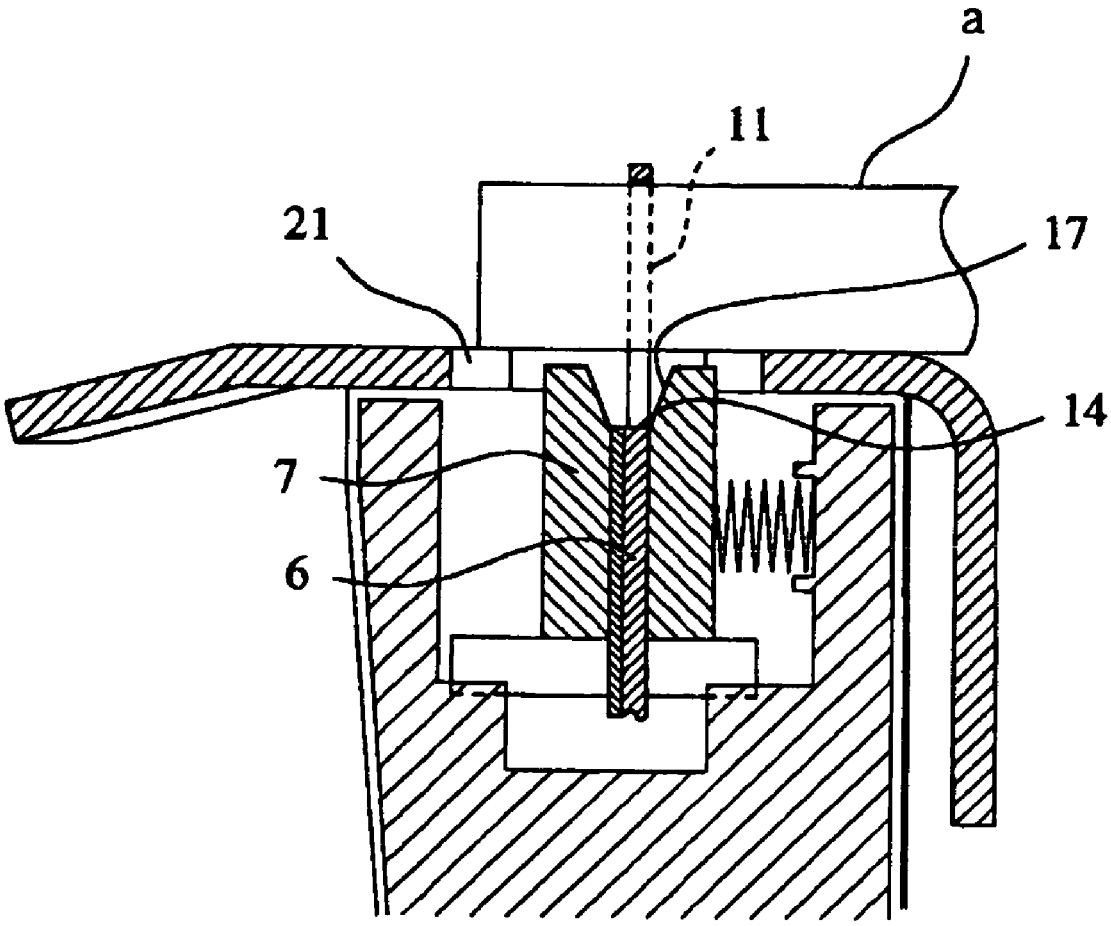
FIG. 7B is a view for explaining the operating manner, illustrating the process in which the legs of the staple are guided by guide faces.
Figure 8:
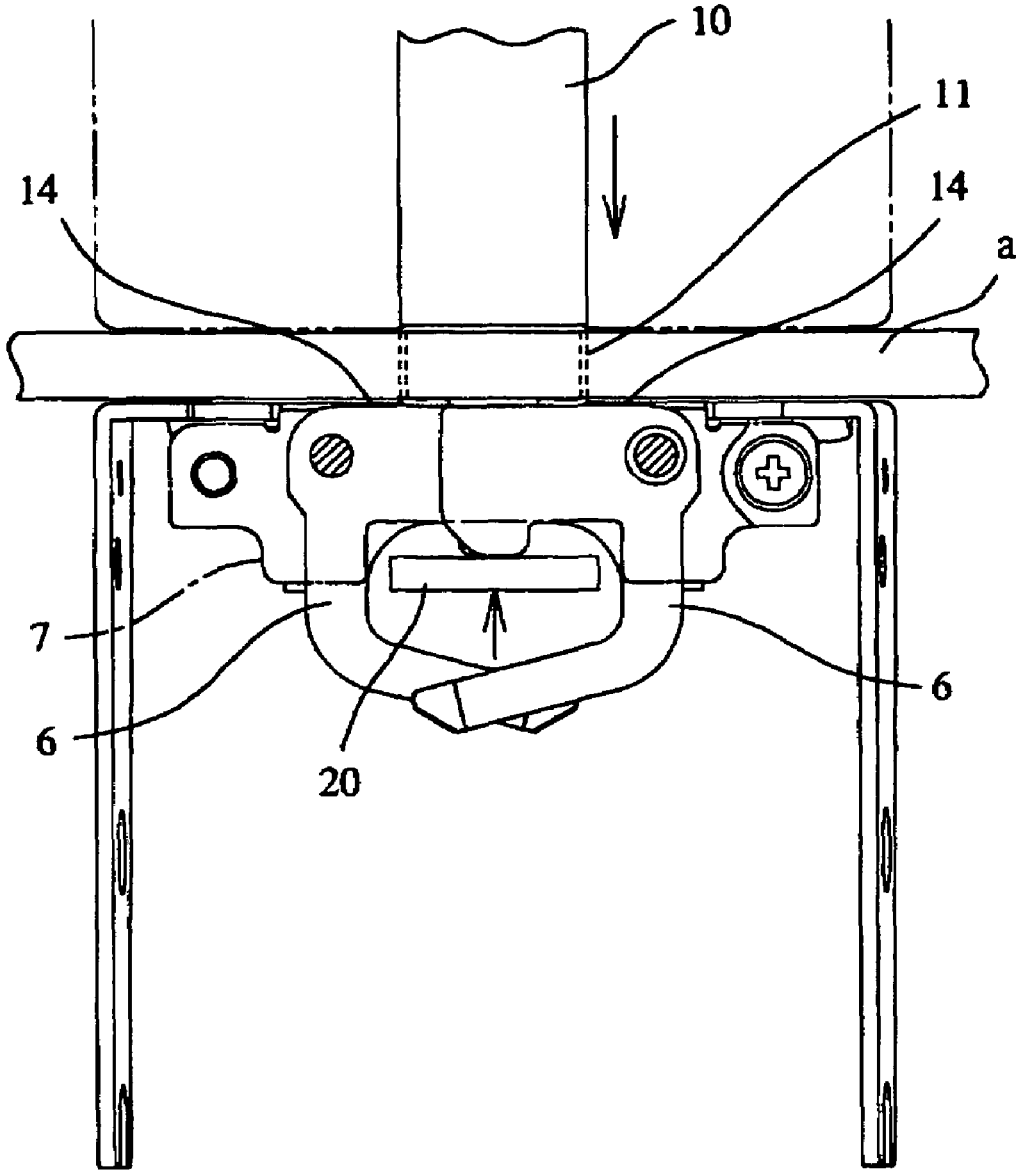
FIG. 8 is a sectional view showing the state where the dropping of the sheets of paper has been prevented.
Figure 9A:
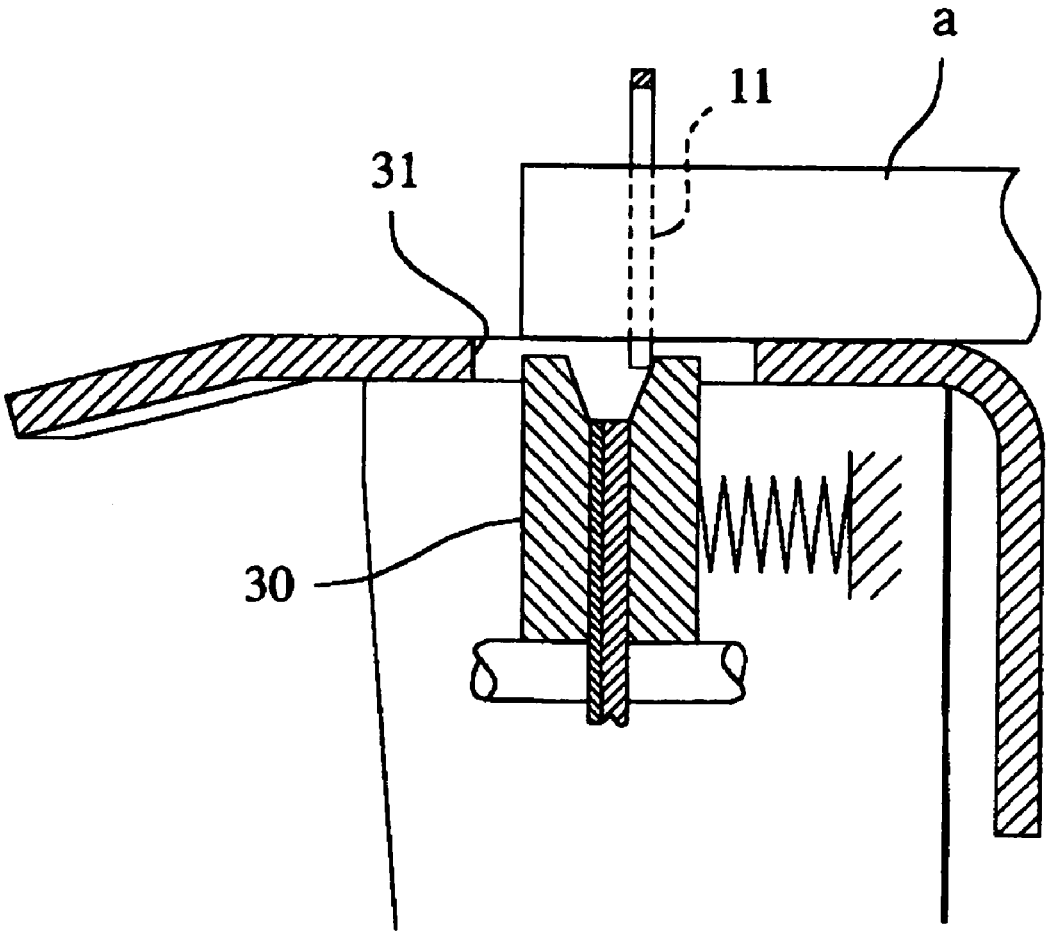
FIG. 9A is a sectional view showing the manner in which the sheets of paper have dropped in a conventional stapler, illustrating the process in which the legs of the staple pass through the sheets of paper.
Figure 9B:
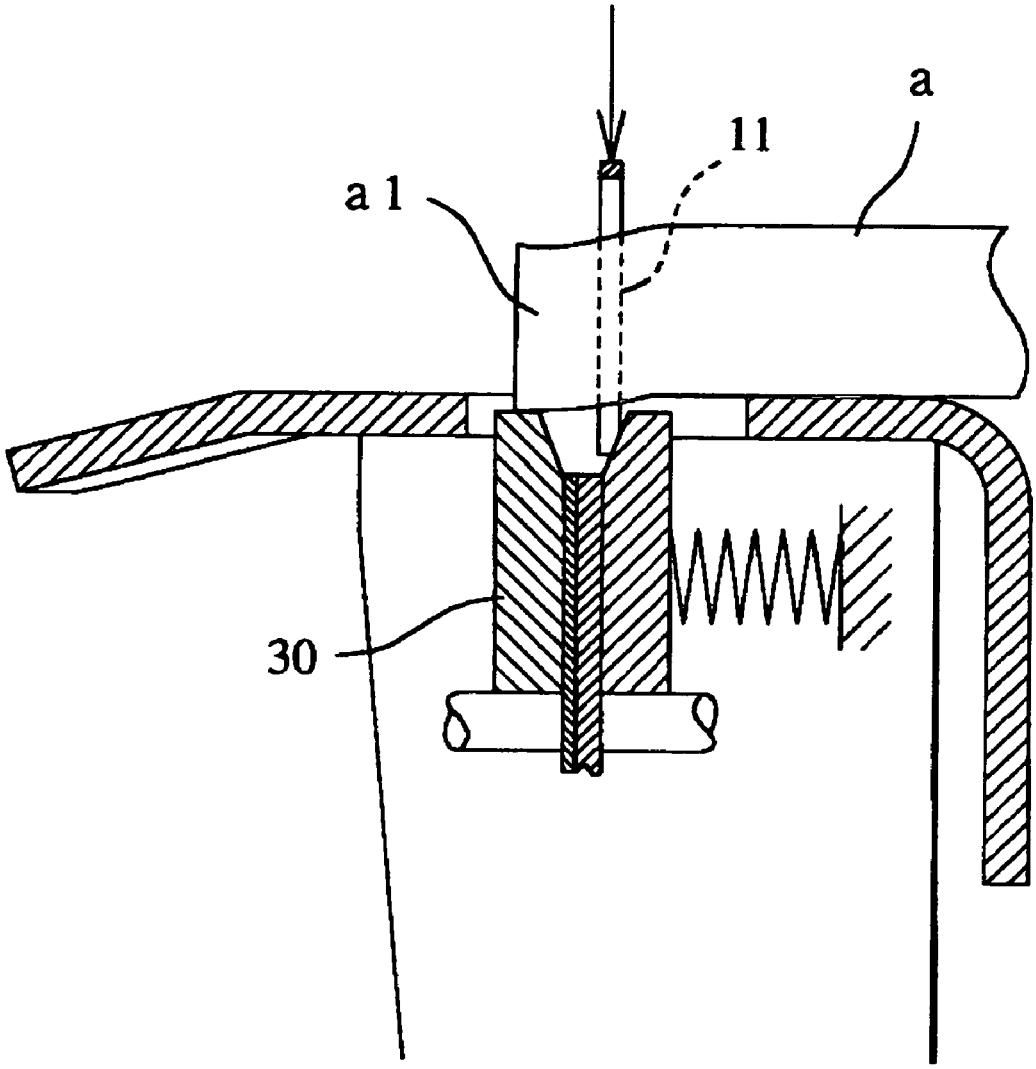
FIG. 9B is a sectional view showing the manner in which the sheets of paper have dropped in a conventional stapler, illustrating the state where the movement of the clincher holder has been interfered.

The legs 11 of the penetrating staple normally drop onto the upper faces 14 of the clinchers 6. However, as the case may be, the legs of the passed-though staple 11 deviate from a predetermined position so that they hit against not the clinchers 6 but the slanting guide face 17. In this case, since the component force in the horizontal direction acts on the guide faces 17, the guide faces 17 are pushed by the legs 11 so that the clincher holders 7 are moved in the opening 9 in an indicated arrow direction against the spring force of the coil spring 18. Thus, as shown in FIG. 7B, the legs 11 of the staple are guided by the guide faces 17 onto the upper faces 14 of the clinchers 6. After the legs 11 of the staple have passed through the staple sheets of paper "a", the driving mechanism for the clinchers 6 operates. Thus, as shown in FIG. 8, as the clinchers 6 are rotated and so their upper faces 14 become horizontal, the legs of the staple 11 are gradually bent and eventually pressed on the rear face of the sheets of paper "a", thereby completing the stapling. In this way, the clinchers 6 move to the positions corresponding to the legs 11 so that the core of the driver and the central position of the clinchers are automatically adjusted as shown in FIG. 2. Accordingly, even if only a component tolerance of e.g. the clinchers 6 but also an attaching error of the stapler by a user are accumulated, the changes in the position due to them are absorbed. As a result, the alignment of the clinchers is made so that the legs 11 of the staple are exactly bent, thus realizing improved stapling.

As described above, the sheets of paper "a" are firmly clamped between the driver unit and the clincher unit. The opening 9 of the stapling stable 1 is formed with the size larger than the clincher holders 7 so that the clincher holders 7 are movable. Thus, the sheets of paper are subjected to pushing force by clamping so that the side end of the sheets of paper"a" is dropped inside the opening 9. This is conspicuous in the case when the position apart about 3 mm from the side end of the sheets of paper "a" is stapled.

Further, since the drop-preventing portions 21 are projected inside the opening 9, as shown in FIGS. 7A and 7B, the pushed-in areas of the sheets of paper are supported by the drop-preventing portions 21 so that they will not drop inside the opening 9. Thus, since the free movement of the clincher holders 7 is not hindered, the legs 11 of the staple can be guided to the upper faces 14 of the clinchers 6. Further, since the sheaf of the sheets of paper "a" does not become deformed, it is possible to surely prevent occurrence of buckling or rolling of the legs 11 of the staple which leads to poor stapling.

The material of the drop-preventing portions 21 should not be limited to metal. The material of the drop-preventing portions 21 may be synthetic resin.

The means for holding the clincher holders, as long as it is any spring means, should not be limited to the coil spring but may be e.g. a plate spring.

The application of the above mechanism for preventing the sheets of paper from dropping should not be necessarily limited to the upper and lower separated type stapler. This mechanism can be also applied to a manual or electric stapler. The clinchers should not be limited to the movable clinchers but may be fixed clinchers.

The present invention has been explained in detail and with reference to the specific embodiment. However, it is apparent for those skilled in the art that the present invention can be varied or modified in various manners without departing from the spirit or scope of the invention.

This application is based on Japanese Patent Application filed on Apr. 14, 2004 (Japanese Patent Application No. 2004-118574), the contents of which are incorporated herein by reference.

INDUSTRIAL APPLICABILITY

In accordance with an embodiment of the present invention, since the drop-preventing portions are projected inside the opening, the pushed-in areas are supported by the drop-preventing portions and so will not drop inside the opening. Therefore, the free movement of the clincher holders is not hindered so that the legs of the staple can be guided to the slanting faces of the clinchers. Further, since the sheaf of the sheets of paper does not become deformed, it is possible to surely prevent occurrence of buckling or rolling of the legs of the staple which leads to poor stapling.

The invention claimed is:

1. A stapler comprising:

a driver for driving a staple in a first direction, wherein the staple has a crown straightly extending in a second direction perpendicular to the first direction and the staple also has legs extending in the first direction from both ends in the second direction of the crown, a table for receiving sheets of paper;

an opening formed in the table;

a clincher holder movable inside the opening; and a drop-preventing portion projected from an opening edge of the opening toward an inside of the opening, wherein the clincher holder is movable with respect to the table in a third direction which is perpendicular to the first direction and the second direction.

2. The stapler according to claim 1, wherein an upper surface of the drop-preventing portion is substantially coplanar with an upper surface of the table.

3. The stapler according to claim 1, further comprising:

a shaft extending in the third direction; and a spring, wherein the clincher holder is movable along the shaft, and the clincher is urged in the third direction by the spring.

4. A stapler comprising:

a table for receiving sheets of paper;

an opening formed in the table;

a clincher holder holding at least one clincher; and a drop-preventing portion projected from an opening edge of the opening toward an inside of the opening, wherein the at least one clincher rotates in a plane perpendicular to a front-and-rear direction, the clincher holder is movable in the front-and-rear direction, and an upper surface of the drop-preventing portion is substantially coplanar with an upper surface of the table.

5. The stapler according to claim 4, wherein the drop-preventing portion is integrally formed with an opposed opening edge of the opening so as to project from the opening edge.

6. The stapler according to claim 4, wherein the clincher holder has a right guiding portion and a left guiding portion.

7. The stapler according to claim 6, wherein each of the right guiding portion and the left guiding portion has a pair of guide faces respectively slanting in a front-and-rear direction.

8. The stapler according to claim 6, wherein the opening has a length longer in a right-and-left direction than in the front-and-rear direction, and the drop-preventing portion is projected from the opening edge toward the inside of the opening between a region of the opening opposed to the right guiding portion and a region of the opening opposed to the left guiding portion.

9. The stapler according to claim 4, further comprising:

a shaft extending in the front-and-rear direction, wherein the clincher holder is movable on the shaft.

10. The stapler according to claim 4, wherein the opening has a length longer in a right-and-left direction than in a front-and-rear direction, and the drop-preventing portion comprises a front drop-preventing portion which is projected toward the inside of the opening at a substantially central position in the right-and-left direction of a front opening edge, and a rear drop-preventing portion which is projected toward the inside of the opening at a substantially central position in the right-and-left direction of a rear opening edge.

11. The stapler according to claim 4, wherein the table has a rectangular shape, and wherein the opening has a rectangular shape.

12. The stapler according to claim 4, wherein an upper surface of the clincher holder is located lower than an upper surface of the table.

13. The stapler according to claim 4, further comprising:

a frame, wherein the table is formed within the frame; and a spring, wherein one end of the spring is secured to the clincher holder and the other end of the spring is secured to the frame.

14. The stapler according to claim 13, further comprising;

a shaft attached to the frame, wherein the clincher holder is supported on the shaft to be movable in the front-and-rear direction.

* * * * *